United States Patent [19]

Stone

[11] 4,054,292

[45] Oct. 18, 1977

[54] GAS SEAL FOR ROTATING GRINDING MILL HAVING PERIPHERAL DISCHARGE

[75] Inventor: Tyrus Hartsel Stone, Belpre, Ohio

[73] Assignee: Union Carbide Corporation, New York, N.Y.

[21] Appl. No.: 751,109

[22] Filed: Dec. 16, 1976

[51] Int. Cl.[2] ..... B02C 4/28; B65D 53/06

[52] U.S. Cl. ..... 277/12; 277/74; 277/75; 277/96.1; 241/48; 241/176; 241/179

[58] Field of Search ..... 241/48, 176–179; 277/3, 27, 74, 75, 81 R, 96, 96.1, 215, DIG. 5, 71, 12

[56] References Cited

U.S. PATENT DOCUMENTS

| | | | |
|---|---|---|---|
| 1,487,849 | 3/1924 | Grauert | 277/12 |
| 1,819,093 | 8/1931 | Hardinge | 241/48 |
| 1,986,103 | 1/1935 | Cole | 241/178 X |
| 2,256,841 | 9/1941 | Hardinge | 241/179 X |
| 3,685,840 | 8/1972 | Henry | 277/75 X |

FOREIGN PATENT DOCUMENTS

| | | | |
|---|---|---|---|
| 830,059 | 3/1960 | United Kingdom | 277/74 |
| 906,838 | 9/1962 | United Kingdom | 277/75 |

*Primary Examiner*—Robert S. Ward, Jr.
*Attorney, Agent, or Firm*—Frederick J. McCarthy, Jr.

[57] ABSTRACT

A gas tight seal is provided for a rotating grinding mill having peripheral discharge outlets.

The mill has a rotatable shell into which the material to be ground is fed. During operation, the shell is provided with a gaseous inert atmosphere.

The seal comprises annular members adjacent the shell with circumferential grooves in said annular members carrying pressurized gas which prevents fine particles from lodging between the bearing surfaces on which the shell rotates and which also prevents loss of inert gas from the shell.

1 Claim, 4 Drawing Figures

GAS SEAL FOR ROTATING GRINDING MILL HAVING PERIPHERAL DISCHARGE

The present invention is directed to a seal for rotating grinding mills. More particularly the present invention is directed to a seal for such mills having peripheral discharge openings.

Grinding mills commonly comprise a rotatable metal; shell member which contains grinding rods or balls which, during rotation of the shell, reduce the solids charged to the mill to a very fine particle size. Such mills discharge the ground particles through peripheral apertures in the rotatable shell. As is known, the grinding of some materials, such as ferroalloy metals and other materials, require that such grinding be accomplished in an inert gas atmosphere, e.g. nitrogen, argon, and the like in order to avoid ignition and explosion hazards.

Up to the present, means for sealing grinding mills of the above-described type in order to effectively utilize inert gas atmospheres have not been available.

It is therefore an object of the present invention to provide a seal for rotating grinding mills operated under inert gas atmosphere.

Other objects will be apparent from the following description and claims taken in conjunction with the drawing wherein:

FIG. 1 shown a conventional rotating grinding mill having a seal in accordance with the present invention incorporated therewith;

Figure 1:
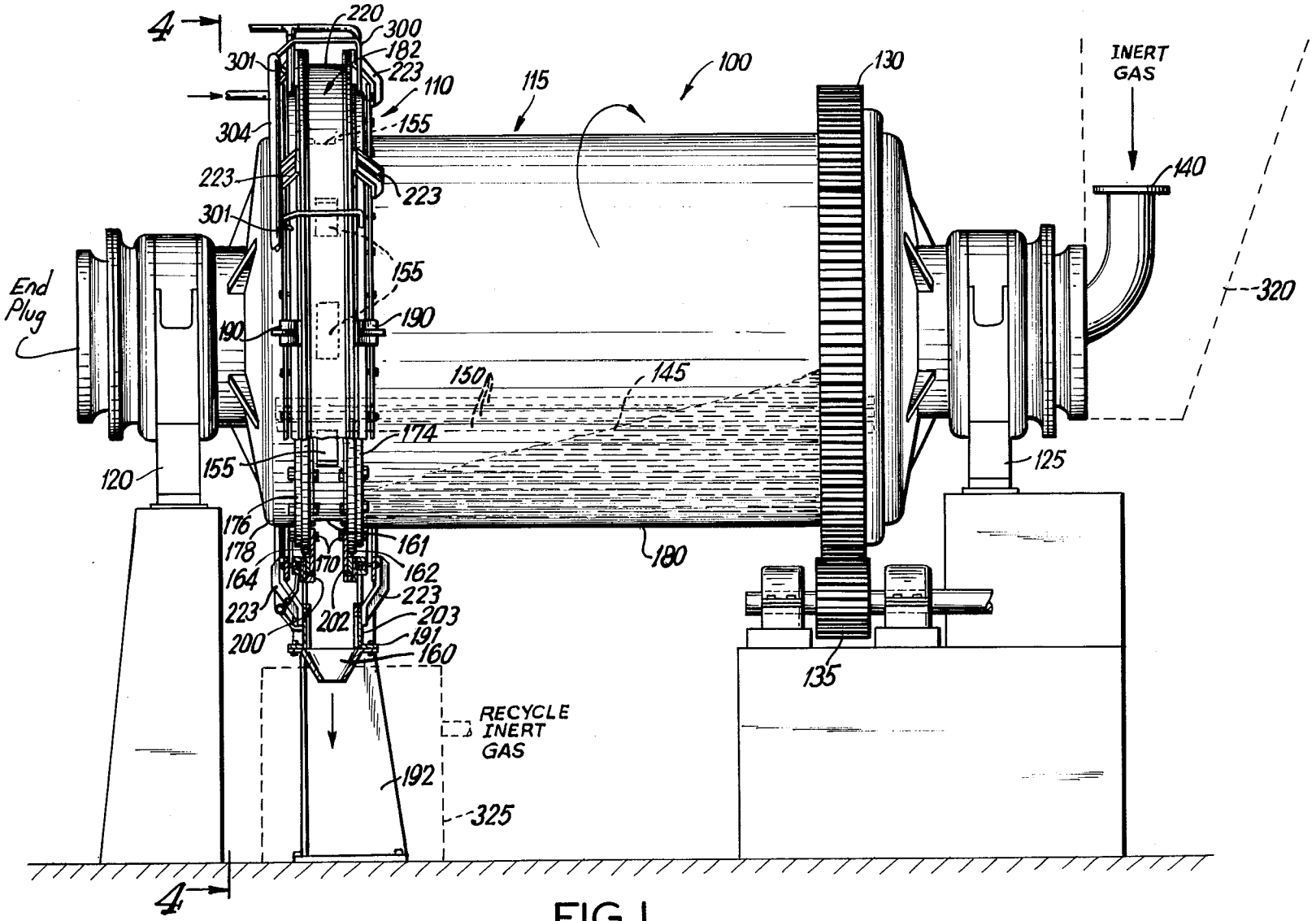

With reference to the drawing, FIG. 1 shows a rotating grinding mill, such as a Denver End Peripheral Discharge Mill as described in Denver Equipment Company Bulletin No. B2-B34-A, with a seal in accordance with the present invention incorporated therewith.

With reference to FIG. 1, the grinding mill is indicated generally at 100 and the seal of the present invention is generally indicated at 110. Mill 100 comprises a metal, e.g., steel shell 115 which is rotatably mounted at trunnions 120 and 125. Shell 115 has a gear 130 affixed thereto which is rotated by conventional drive gear arrangement 135. In operation, the material to be ground is fed through inlet 140 into rotatable shell 115 where it is reduced to fine sized material 145 by the action of rods 150 contained in rotating shell 115. The fine sized material 145 exits shell 115 into trough 160 through apertures 155 which are arranged in a circumferential row. Shell 115, as shown in FIG. 1 comprises an intermediate section 161 in which apertures 155 are located. Section 161 has a pair of parallel, planar circumferential flanges 162 and 164 which are bolted as indicated at 170 to generally similar flanges 174 and 176 on the end portion 178 and main portion 180 of shell 115.

The seal of the present invention comprises a stationary seal housing member indicated at 182, which is fixedly mounted at 190 and 191 to supports 192, in combination with spaced, planar, parallel circular rotatable ring members 200 and 202 which are fixed to flanges 162 and 164 of intermediate shell section 161 and are rotatable therewith.

Figure 2:
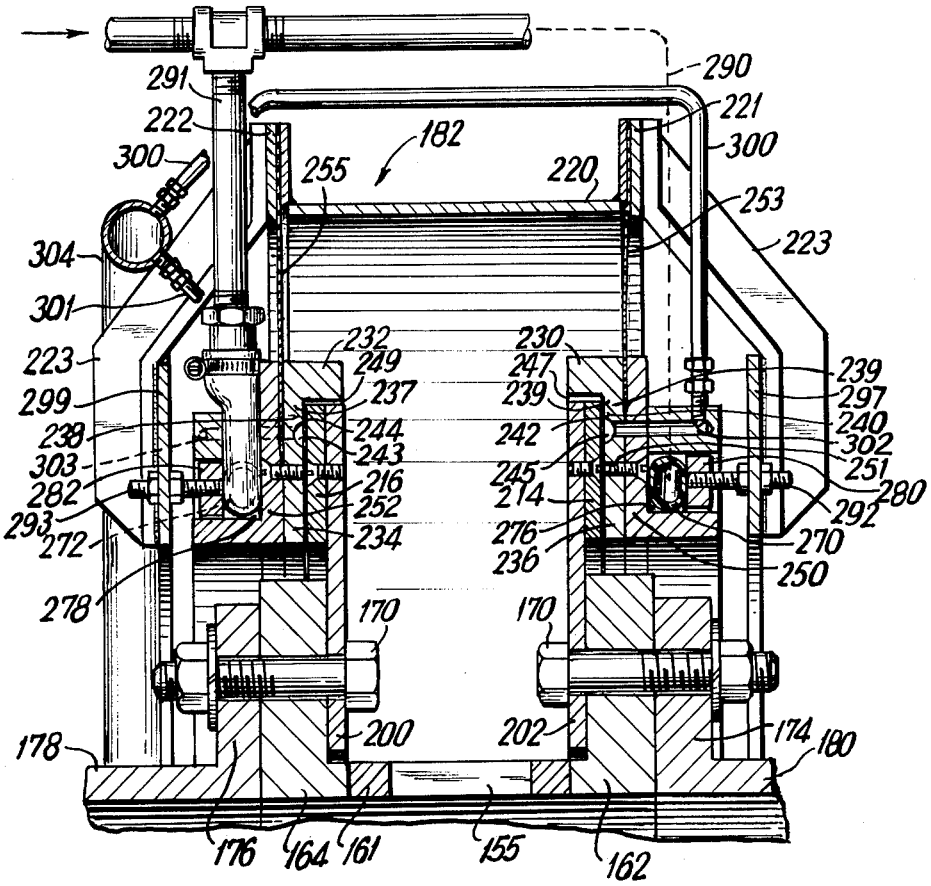
FIG. 2 shows a representative upper sectional elevation view of a portion of a seal in accordance with the present invention.
Figure 3:
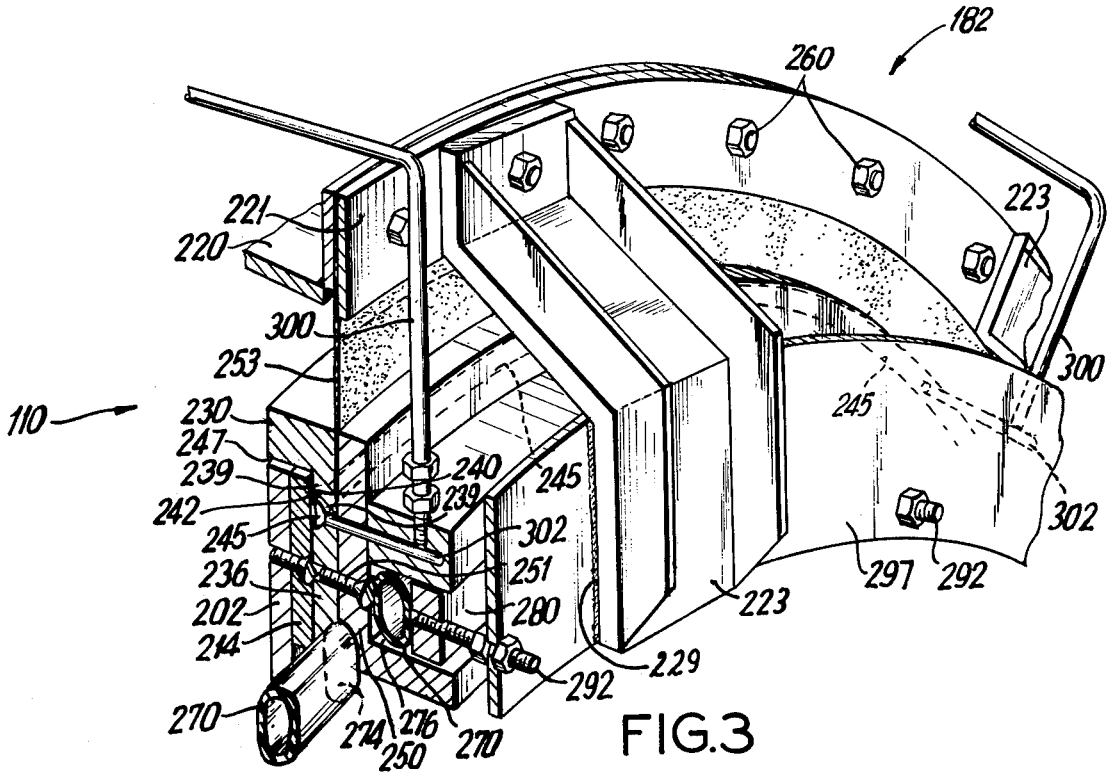
FIG. 3 shows an isometric view of a representative portion of the view of FIG. 2.
Figure 4:
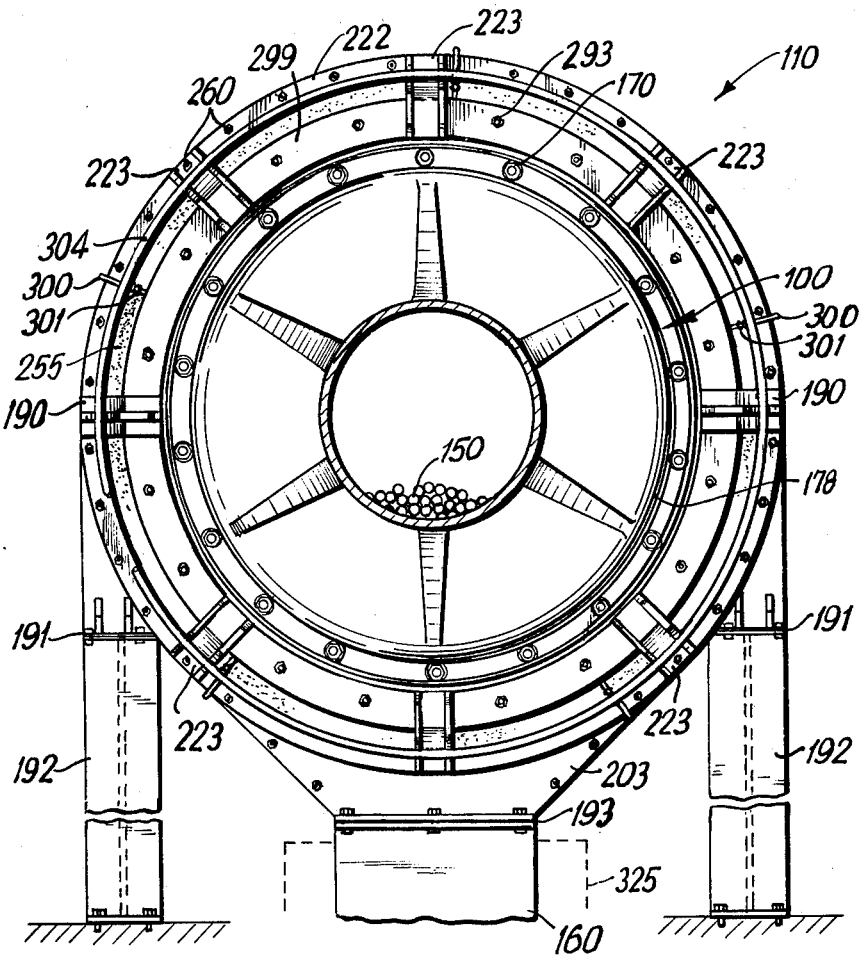
FIG. 4 shows an end view of the device shown in FIG. 1.

The seal of the present invention will be more fully understood with reference to FIG. 2 in conjunction with FIG. 1. FIG. 2 shows the details of the representative upper portion of the housing 182 of FIG. 1, and FIG. 3, shows an isometric view of a representative portion of the right hand portion of the view of FIG. 2. Housing member 182 is symmetrical about its horizontal and vertical axes, except for extension 203 which provides a gas tight communication at 193 with trough 160.

With reference to FIG. 2, rotatable intermediate shell section 161 has flanges 162 and 164 to which are secured at 170, circumferential, planar, parallel, circular metal plates 200 and 202. Circular, circumferential, planar bearing plates 214 and 216 are affixed to the outside surfaces of 200 and 202 respectively and the bearing plates 214 and 216 thus rotate with the rotatable intermediate shell section 161. Annular housing member 182 encloses and surrounds the intermediate shell section 161, and bearing surfaces 214 and 216, except for exit of ground material into trough 160, and comprises a flanged outer ring member 220 to which are attached circumferential rims 221 and 222 and a plurality of peripheral angle support members 223, e.g. eight in number, which hold housing member 182 in a stationary position as hereinafter described. A pair of parallel rings 230 and 232 are fixedly positioned in housing 182, as hereinafter described and have circumferential planar portions 234 and 236 which are positioned as bearing surfaces in contact with adjacent rotatable bearing plates 214 and 216. Each of rings 230 and 232 has a second portion 237, 239 with circumferential surfaces 238 and 240 slightly spaced from rotatable bearing plates 214 and 216. Spaces 242 and 244 are provided between fixed rings 230, 232 and rotating bearing plates 214 and 216 and spaces 247 and 249 are provided between rings 230, 232 and rings 200, 202 as gas passages as hereinafter described. Circumferential grooves 243 and 245 communicate with spaces 242 and 244 respectively. Stationary ring 230 has a plate 250 attached thereto at 251 which sealably engages a circumferential flexible diaphragm member 253; member 253 is similarly engaged between rim 221 and stationary flanged outer ring member 220. As shown in FIG. 2, a corresponding flexible diaphragm member 255 is similarly engaged by plate 252 and rim 222 and ring member 220. The diaphragm members 253 and 255 are suitably made of heavy gauge rubber and provide a lateral sealed enclosure for seal 182. Seal 182 is assembled by affixing rims 221 and 222, and diaphragms 253 and 255 to flanged ring member 220, e.g. by means of bolts 260, together with angle support member 223. Rings 230 and 232 are arranged, with diaphragms 253 and 255 in place, adjacent bearing plates 214 and 216. Inflatable elastic tube members 270 and 272, sealed at one end as indicated at 274 in FIG. 3, are arranged in circumferential slots 276 and 278 of stationary ring members 230 and 232 and circular bars 280 and 282 are placed behind the inflatable members 270 and 272. A pressurized gas is introduced into inflatable members 270 and 272 via conduits 290 and 291 and bolts 292 in rims 297 and 299 which are welded to members 223 as indicated at 229 are adjusted to provide an adequate force against rings 230 and 232 to maintain rings 230 and 232 stationary and in bearing contact with rotatable bearing plates 214 and 216 during rotation of shell member 115. A plurality of circumferentially arranged gas conduits 300, 301 are arranged to communicate with a plurality of corresponding passages 302, 303 and pressurized inert gas is introduced via conduit 304 to conduits 300 and 301. From conduits 300, 301 gas passes into circumferential grooves 243 and 245 into spaces 242 and 244 and 247 and 249 and into shell 115. During operation, shell 115 is provided with an inert gas atmosphere, for example, by means of gas introduced into a gas tight enclosure indicated at 320 in FIG. 1. The inert gas exits the mill 100 via apertures 155, seal 110 and trough 160 into a gas tight enclosure indicated at 325 from which the inert gas can be recycled to the inlet enclosure 320. Due to the formation during grinding of very fine particles in mill 100, inert gas, at a pressure higher than that in mill 100, is introduced from conduit 304 into conduits 300 and 301. With reference to FIGS. 2 and 3, the gas from conduits 300 enters circumferential grooves 243 and 245 as previously described and passes through circumferential spaces 242, 244 and 247, 249 into the interior of shell 115. This circumferential inward flow of gas into shell 115 prevents very fine particles from lodging between the contacting bearing surfaces 234, 236 of rings 230, 232 and rotatable bearing plates 214 and 216. A rotating seal arrangement is thus provided which prevents loss of inert gas from mill 100.

What is claimed is:

1. A seal for a rotating mill having a rotatable cylindrical shell and a plurality of apertures arranged in a circumferential row, said seal comprising a first pair of spaced, parallel, planar, circular, rotatable ring members sealably attached to said shell with said circumferential row of apertures lying between said rotatable ring members, each of said rotatable ring members having a circumferential bearing surface at its side remote from said row of apertures, a fixedly mounted annular gas-tight seal housing member arranged around said row of apertures and said first pair of ring members, said housing member having a pair of spaced fixedly mounted ring members arranged adjacent said pair of rotatable ring members, each of said pair of fixedly mounted ring members having a first portion with a circumferential planar bearing surface in sliding contact with a bearing surface of an adjacent rotatable ring member and a second portion with a circumferential surface slightly spaced from said bearing surface of such adjacent rotatable ring member, each said first portion having a circumferential groove adjacent said second portion; a plurality of circumferentially spaced gas conduit means communicating with each of said grooves whereby gas introduced into said conduit means enters said grooves and passes between the second portions of said fixedly mounted ring members and the bearing surfaces of said rotatable ring members into said rotating cylindrical shell of said mill.

* * * * *